US010967393B2

(12) United States Patent
Lubeck et al.

(10) Patent No.: US 10,967,393 B2
(45) Date of Patent: Apr. 6, 2021

(54) MULTIHEAD SPRAY GUN SYSTEM

(71) Applicant: BOSS SPRAY TECHNOLOGIES INC., Spruce Grove (CA)

(72) Inventors: Gerald M. Lubeck, Spruce Grove (CA); Gordon J. Maginnis, Spruce Grove (CA)

(73) Assignee: BOSS SPRAY TECHNOLOGIES INC., Spruce Grove (CA)

( * ) Notice: Subject to any disclaimer, the term of this patent is extended or adjusted under 35 U.S.C. 154(b) by 0 days.

(21) Appl. No.: 16/548,620

(22) Filed: Aug. 22, 2019

(65) Prior Publication Data

US 2020/0061645 A1 Feb. 27, 2020

Related U.S. Application Data

(60) Provisional application No. 62/722,113, filed on Aug. 23, 2018.

(51) Int. Cl.

| | |
|---|---|
| ***B05B 7/24*** | (2006.01) |
| ***B05B 12/00*** | (2018.01) |
| ***B05B 7/22*** | (2006.01) |

(52) U.S. Cl.

CPC ..... *B05B 7/2486* (2013.01); *B05B 7/22* (2013.01); *B05B 12/006* (2013.01)

(58) Field of Classification Search

CPC ..... B05B 7/2486; B05B 7/22; B05B 12/006; B05B 12/04; B05B 12/1472

See application file for complete search history.

(56) References Cited

U.S. PATENT DOCUMENTS

| | | | | |
|---|---|---|---|---|
| 5,058,805 | A * | 10/1991 | Anderson | B05B 5/025 239/3 |
| 5,092,265 | A * | 3/1992 | Hughes | B05B 3/022 118/317 |
| 5,275,184 | A * | 1/1994 | Nishizawa | B08B 3/10 134/57 R |
| 6,314,996 | B1 | 11/2001 | Borglum et al. | |
| 2003/0127542 | A1 | 7/2003 | Cooper | |
| 2005/0023296 | A1* | 2/2005 | Bien | B05B 7/166 222/146.1 |
| 2005/0035226 | A1 | 2/2005 | Schebesta et al. | |
| 2008/0110926 | A1* | 5/2008 | Cocciadiferro | B29B 7/7678 222/54 |
| 2020/0061645 | A1* | 2/2020 | Lubeck | B05B 7/2486 |

FOREIGN PATENT DOCUMENTS

| | | |
|---|---|---|
| JP | H10216576 A | 8/1998 |

* cited by examiner

*Primary Examiner* — Vishal Pancholi
*Assistant Examiner* — Bob Zadeh
(74) *Attorney, Agent, or Firm* — Bennett Jones LLP

(57) ABSTRACT

A spray system allows operation of two spray guns from a single two-component spray system. The system includes a fluid block defining a first chemical fluid passageway which connects a first chemical inlet, a first chemical spool valve, and two first chemical outlets, and second chemical fluid passageway which connects a second chemical inlet, a second chemical spool valve and two second chemical outlets.

11 Claims, 3 Drawing Sheets

MULTIHEAD SPRAY GUN SYSTEM

FIELD OF THE INVENTION

The present invention relates generally to methods and systems for spraying two-part polymer foams with a single spray system and at least two spray guns.

BACKGROUND OF THE INVENTION

Spray foam insulation has long been used commercially and is increasingly being used in residential construction and renovation projects. It is thought to be much more efficient and effective insulation than fiberglass batts or other similar insulating material.

Spray foam is typically a polyurethane foam produced by reacting an isocyanate containing two or more isocyanate groups per molecule with a polyol containing on average two or more hydroxyl groups per molecule, in the presence of a catalyst or by activation with ultraviolet light. It is applied by delivering the two components in precise ratios and at an elevated temperature to a spray gun under pressure, where the components are mixed in a mixing chamber and immediately expelled in a relatively fine spray. A spray gun system includes two storage tanks for the two chemical components, a pump for each chemical component, and a heater.

If applied incorrectly, the spray foam will fail to cure properly, and may crack, off-gas or cause other problems. Off-gassing produces fumes that are at the very least noxious and potentially toxic. Correct application requires the two components be mixed in the correct ratio and/or at the correct temperature, otherwise these problems can occur. For that reason, it has not been possible to drive two or more spray guns from the same system. The on/off cycling of one gun has invariably caused pressure imbalances and fluctuating flow rates for the other gun.

SUMMARY OF THE INVENTION

In one aspect, the present invention comprises as system for spraying two-part polymer foams with at least two spray guns from a single system.

In one embodiment, the invention comprises a spray system comprising:

(a) a first chemical storage tank and second chemical storage tank, each with an associated pump;

(b) a spray machine which receives the output of the first chemical pump and the second chemical pump and produces a pressurized first and second chemical flows, and which optionally comprises at least one heating element to heat each the first and second chemicals to a desired temperature;

(c) a fluid block defining a first chemical fluid passageway which connects a first chemical inlet receiving the first chemical flow from the spray machine, a first chemical spool valve, and two first chemical outlets, and second chemical fluid passageway which connects a second chemical inlet receiving the second chemical flow from the spray machine, a second chemical spool valve and two second chemical outlets;

(d) a first hose which connects to one first chemical outlet and one second chemical outlet at one end, and a first spray gun at a distal end;

(e) a second hose which connects to the other first chemical outlet and the other second chemical outlet at a proximal end, and second spray gun at a distal end.

In another aspect, the invention may comprise a fluid block, for use in a spray system for driving two spray guns from a single system, the fluid block defining a first chemical fluid passageway which connects a first chemical inlet, a first chemical spool valve, and two first chemical outlets, and second chemical fluid passageway which connects a second chemical inlet, a second chemical spool valve and two second chemical outlets.

BRIEF DESCRIPTION OF THE DRAWINGS

In the drawings shown in the specification, like elements may be assigned like reference numerals. The drawings may not be to scale, with the emphasis instead placed upon the principles of the present invention. Additionally, each of the embodiments depicted are but one of a number of possible arrangements utilizing the fundamental concepts of the present invention.

DETAILED DESCRIPTION OF EMBODIMENTS OF THE INVENTION

Figure 1:
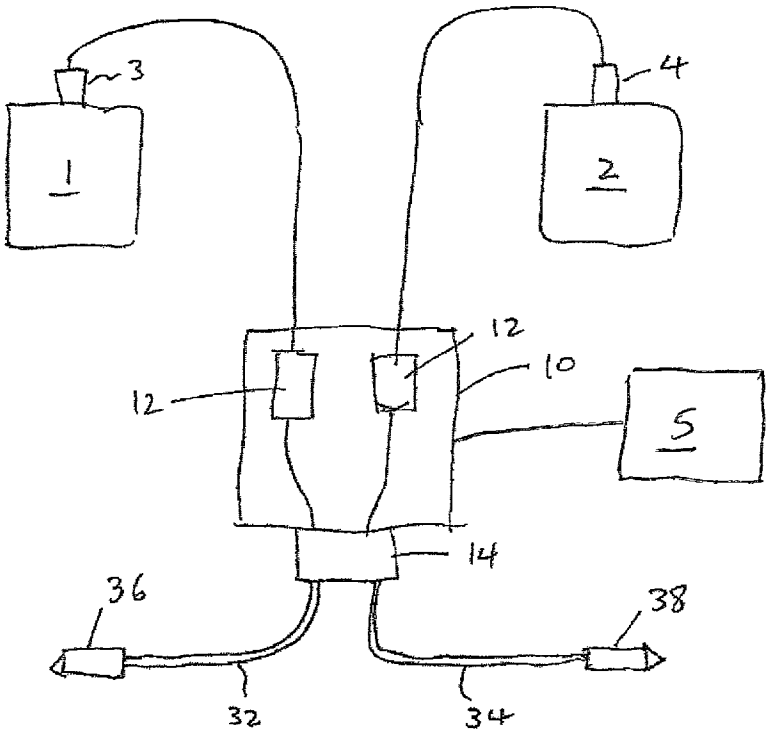
FIG. 1—Schematic Depiction of one embodiment of a Dual Spray Gun system.
Figure 2:
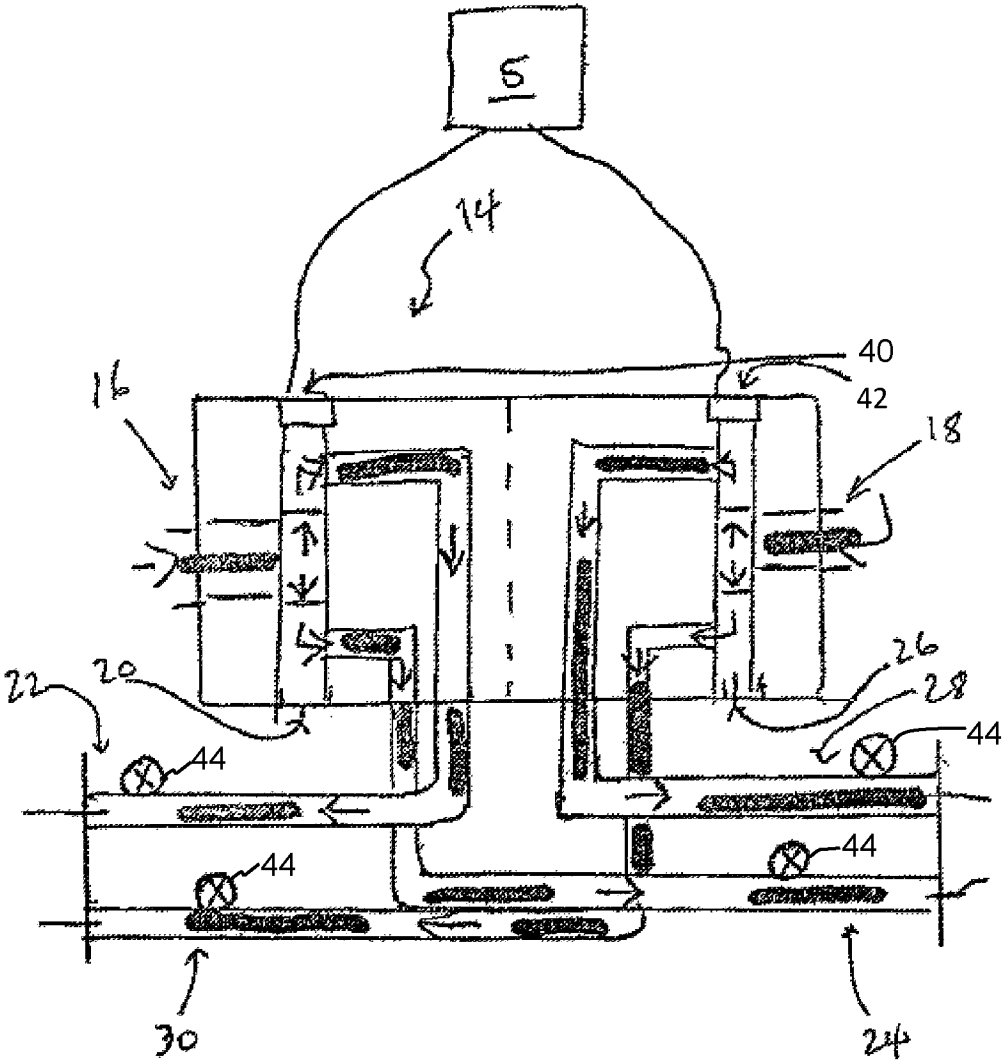
FIG. 2—Schematic Diagram of one embodiment of a Fluid Block
Figure 3:
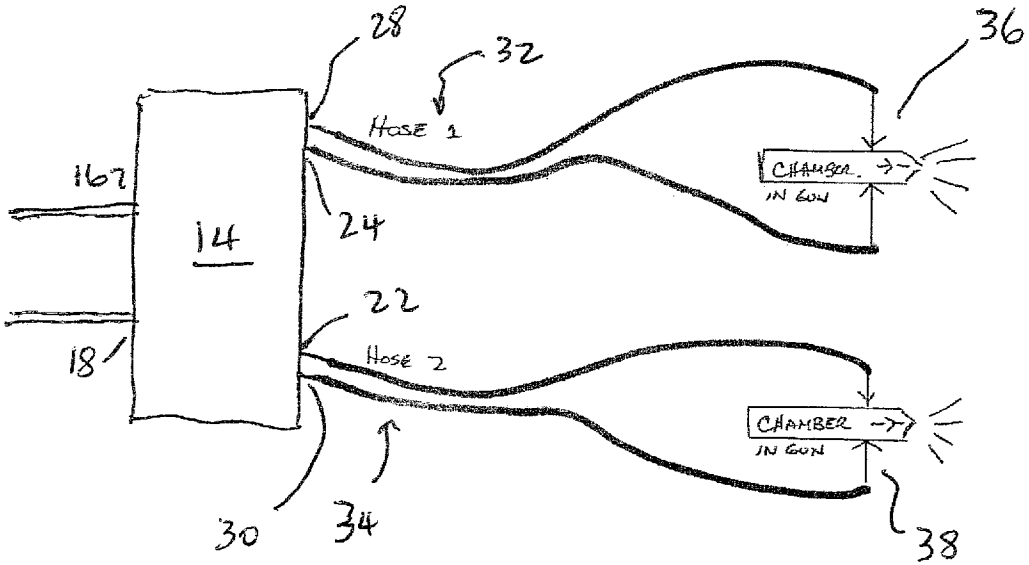
FIG. 3—Schematic Depiction of Two Hoses running from the fluid block to two spray guns, each with a mixing chamber.

In general terms, the invention comprises two-component spray gun system which permits the use of at least two spray guns from a single spray system. Accordingly, each of the two spray guns draws from the same chemical source and pressure source as the other.

Therefore, in some embodiments, the system comprises a first chemical storage tank (1) and second chemical storage tank (2), each with an associated pump (3, 4), which may be a stick transfer pump as is well known in the industry. In this description, the first chemical isocyanate will be referred to by its colloquial name "iso", while the second chemical will be referred to as "resin", which is typically a polyol composition. However, the system may be used for any two-component spray system, and is not restricted to polyurethane spray systems which combine isocyanates and polyols.

This is a single system because there is a single chemical source and a single pressure source (pump) for each component, which is then split and delivered to each of the spray guns (36, 38). The two components are separately delivered to each spray gun, where they are combined and sprayed in conventional manner.

The iso and the resin will thus enter a spray machine (10) at high pressure, for example about 200 p.s.i. The spray machine (10) includes at least one heating element (12) to heat each chemical flow to a desired temperature and a proportioner which increases the flow to operating pressures, which can be up to 2000 psi, but is typically in the range of about 900 to 1200 psi.

The spray machine also comprises or is connected to a fluid block (14) where the iso stream and the resin stream are divided and routed out separate hoses, leading to separate spray guns. The fluid block comprises an iso fluid inlet (16) and a resin fluid inlet (18). The iso fluid path passes through an iso spool valve (20) and to a first iso outlet (22) and a second iso outlet (24). The resin fluid path passes through a resin spool valve (26) and to a first resin outlet (28) and a second resin outlet (30). The first iso and first resin outlets lead to separate conduits within a first hose (32), while the second iso and second resin outlets lead to separate conduits within a second hose (34). The first hose (32) leads to a first spray gun (36) and the second hose (34) leads to a second spray gun (38), which preferably are identical.

The spool valves (20, 26) are balanced spool valves which each have a single inlet and dual outlets, separated by a sliding spool having O-ring seals which balances flow to the two outlets. Balanced dual outlet spool valves are well known in the art and need not be described further herein.

In some embodiments, an iso pressure transducer (40) measures the pressure in the iso spool valve (20) and connects to an operating control system (5). A resin pressure transducer (42) measures the pressure in the resin spool valve (26) and is also operatively connected to the control system (5). The transducers may communicate with the control system by conventional wired or wireless connections. The control system may continuously monitor and compare the pressures from each of the spool valves, and if the control system detects anomalous pressures, it may shut down the machine (10) and/or the transfer pumps (3, 4) to turn the system off, and/or notify an operator. For example, if the pressure are different from each other, or if they are both operating outside of desired pressure ranges (ie. too high or too low), the control system may be configured to switch off the machine (10) proportioner. In preferred embodiments, the control system may display an error message or fault code indicating a pressure imbalance.

Pressure gauges (44) may be placed on each outlet from the fluid block to provide actual operating pressure near the hose connection, independent from each of the other flows. In some embodiments, the pressure gauges may also be operatively connected to the control system, and provide digital pressure information to be displayed. Alternatively, the pressure gauges may be analog and show pressure in a traditional manner.

Embodiments of the present invention solve a well-known problem known as "winking", where a single pressure source leads to two switchable outlets. Winking occurs where the two outlets alternate between standing pressure (pumps running and system is pressured up) to dynamic pressure (pumps running and spray gun active), resulting in momentary pressure imbalances between the two outlets. If one outlet is opened, there will be temporary pressure loss at the other outlet, or conversely, if an outlet is closed, there will be a temporary pressure increase at the other outlet. In a two-component spray system, winking will cause unequal component ratios, which leads to faulty installations. The fluid block and the spool valves of the present invention result in operating pressure of both outlets to remain substantially equal as the system goes from standing pressure to dynamic pressure from either or both spray guns.

It is important to maintain balanced conditions at each spray gun, therefore, each spray gun should preferably be equipped with the same size mixing chamber. Furthermore, it is preferred that the hose length separating the fluid block (14) from the spray guns be substantially the same for the two spray guns, to allow for substantially equal accumulation of pressure and back pressure between the spool valve to the spray gun hose connection. For example, the difference in hose lengths for each side should be less than 50 feet, and preferably less. More preferably the hose lengths are identical.

There are common conditions which cause pressure imbalances in a two-component spray system. There may be insufficient flow or pressure upstream from the fluid block (14). There may be a restriction or obstruction downstream from the fluid block, for example in a hose or in the spray gun mixing chamber. Also, a leak anywhere in the system could cause a pressure imbalance. The present inventive system may permit continued operation of two separate spray guns in any scenario, by allowing for pressure equalization of the separate flow paths.

Although an embodiment has been described with dual spray guns, the principles of the invention may implemented to produce a system running three or more spray guns from a single spray machine. In some embodiments, a modified spool valve, or combinations of spool valves may be used to achieve such a system.

Interpretation.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of +5%, ±10%, 20%, or +25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. A spray system comprising:

(a) a first chemical storage tank and second chemical storage tank, each with an associated pump;

(b) a spray machine which receives the output of the first chemical pump and the second chemical pump and produces a pressurized first and second chemical flows;

(c) a fluid block defining a first chemical fluid passageway which connects a first chemical inlet receiving the first chemical flow from the spray machine, passing through a first chemical spool valve to two first chemical outlets, and second chemical fluid passageway which connects a second chemical inlet receiving the second chemical flow from the spray machine, passing through a second chemical spool valve, to two second chemical outlets;

(d) a first hose which connects to one first chemical outlet and one second chemical outlet at one end, and a first spray gun at a distal end;

(e) a second hose which connects to the other first chemical outlet and the other second chemical outlet at a proximal end, and second spray gun at a distal end.

2. The system of claim 1 wherein the length of the first and second hose are not more than 50 feet different.

3. The system of claim 2 wherein the first and second hoses are the same length.

4. The system of claim 1 wherein the first and second spray guns are identical.

5. The system of claim 1 wherein each of the first chemical spool valve and the second chemical spool valve is a balanced spool valve having a single inlet and two outlets.

6. The system of claim 1 wherein each of the first chemical spool valve and the second chemical spool valve comprises a pressure transducer for measuring pressure in the first and second chemical fluid passageways, each operatively connected to a control system which is adapted to turn the system off in the event of a pressure imbalance.

7. The system of claim 1 wherein each of the first chemical outlets and the second chemical outlets comprises a pressure gauge visible to a user, and/or which is operatively connected to the control system to record and/or display.

8. The system of claim 1 wherein the spray machine comprises at least one heating element to heat each the first and second chemicals to a desired temperature.

9. A fluid block for use in a spray system for driving two spray guns from a single system, the fluid block defining a first chemical fluid passageway which connects a first chemical inlet, passing through a first chemical spool valve, to two first chemical outlets, and second chemical fluid passageway which connects a second chemical inlet, passing through a second chemical spool valve, to two second chemical outlets.

10. The fluid block of claim 9 wherein each of the first chemical spool valve and the second chemical spool valve further comprises a pressure transducer.

11. The fluid block of claim 9 wherein each of the first chemical spool valve and the second chemical spool valve is a balanced spool valve having a single inlet and two outlets.

* * * * *